US005925197A

United States Patent [19]

Galli

[11] Patent Number: 5,925,197

[45] Date of Patent: Jul. 20, 1999

[54] HARD ALLOYS FOR TOOLS IN THE WOOD INDUSTRY

[75] Inventor: Enrico Galli, Kokkedal, Denmark

[73] Assignee: Sandvik AB, Sandviken, Sweden

[21] Appl. No.: 08/430,308

[22] Filed: Apr. 28, 1995

Related U.S. Application Data

[63] Continuation of application No. 08/092,514, Jul. 16, 1993, abandoned, which is a continuation-in-part of application No. 07/825,271, Jan. 24, 1992, abandoned.

[30] Foreign Application Priority Data

Jul. 17, 1992 [SE] Sweden ..... 9202194

[51] Int. Cl.[6] ..... C22C 19/03

[52] U.S. Cl. ..... 148/409; 148/408; 148/410; 148/425; 148/427; 75/236; 75/240; 75/242

[58] Field of Search ..... 148/408, 409, 148/410, 425, 427; 75/240, 236, 242

[56] References Cited

U.S. PATENT DOCUMENTS

| | | | |
|---|---|---|---|
| 3,811,961 | 5/1974 | Weinstein et al. | 148/34 |
| 4,145,213 | 3/1979 | Oskarsson et al. | 75/242 |
| 4,497,660 | 2/1985 | Lindholm | 75/240 |
| 4,589,917 | 5/1986 | Nagato | 75/240 |
| 4,684,405 | 8/1987 | Kolaska et al. | 75/240 |
| 4,950,328 | 8/1990 | Odani et al. | 75/240 |

FOREIGN PATENT DOCUMENTS

| | | |
|---|---|---|
| 214679 | 3/1987 | European Pat. Off. . |
| 520465 | 12/1992 | European Pat. Off. . |
| 2417186 | 2/1977 | Germany . |
| 3837006 | 5/1990 | Germany . |
| 60-89543 | 5/1985 | Japan . |
| 60-135502 | 7/1985 | Japan . |
| 2176807 | 1/1987 | United Kingdom . |

OTHER PUBLICATIONS

Patent Abstracts of Japan, vol. 9, No. 293 (C–315), abstract of JP 60–135552.

Patent Abstracts of Japan, vol. 10, No. 161 (C–352), abstract of JP 61–12847.

Patent Abstracts of Japan, vol. 10, No. 245 (C–368), abstract of JP 61–76645.

Patent Abstracts of Japan, vol. 10, No. 245 (C–368), abstract of JP 61–76646.

*Primary Examiner*—David A. Simmons
*Assistant Examiner*—Robert R. Koehler
*Attorney, Agent, or Firm*—Burns, Doane, Swecker & Mathis, L.L.P.

[57] ABSTRACT

A sintered hard alloy for tools for cutting wood. The alloy according to the present invention comprises 30–98 volume % hard constituents in a binder phase based on nickel and/or cobalt. The hard constituents comprise oxides, carbides, nitrides and/or borides of Al, Zr, Si and/or Ti, preferably $Al_2O_3$, ZrC, $ZrO_2$, SiC, $Si_3N_4$ and/or $TiB_2$ with a mean grain size <1.5 $\mu$m, preferably <1.0 $\mu$m. The binder phase comprises in solution, in weight %, Co max 90, Ni max 90, Cr 5–45.

15 Claims, No Drawings

HARD ALLOYS FOR TOOLS IN THE WOOD INDUSTRY

CROSS-REFERENCE TO RELATED APPLICATION

This Application is a Continuation of application Ser. No. 08/092,514, filed Jul. 16, 1993, now abandoned, which is a Continuation-In-Part Application of application Ser. No. 07/825,271, filed Jan. 24, 1992, now abandoned.

BACKGROUND OF THE INVENTION

The present invention relates to new hard materials with excellent properties for tools in the wood industry. More particularly, the invention relates to hard materials in which a corrosion and oxidation resistant phase has been distributed in a corrosion and oxidation resistant monophase binder based on cobalt and/or nickel and chromium.

Reconstructed wood products, such as medium density fiberboard and chipboard, are, together with solid wood, the main raw materials in the furniture industry. The are also used to some extent in the housing industry, These products are machined with a variety of tool materials, from high speed steel to cemented carbide to polycrystalline diamond. A leading role has been and is still being played by tools made with cemented carbides.

Cemented carbide grades used for woodworking tools consist generally of WC and cobalt as a binder to hold together the WC crystals. Sometimes small amounts of other carbides are added to improve control of the grain size distribution.

Abrasion has been thought to be the primary mechanism of tool wear when machining reconstituted wood products and solid wood. Recent work has proven that chemical mechanisms such as corrosion and oxidation play a significant role in the degradation of cutting edges as the temperature increases dramatically during the machining process.

The chemical degradation of WC-Co tools is at least a two stage process when machining wood products.

At first, the degradation occurs at a low temperature (300–500° C.), in the early period of cutting. As the tool temperature rises, the wood products decompose and numerous chemicals are introduced in the cutting environment. Up to 213 different compounds have been identified upon the destructive distillation of wood. The machining of medium density fiberboard and particle board produces even more decomposition products. These products contain also a binder such as urea, formaldehyde, wax and glue fillers, extenders and possibly chemicals added as flame retardants. The decomposition products formed are highly corrosive and attack the cobalt binder that holds the WC grains together. When this occurs, the WC grains are removed by chemical action and the cutting edge loses its sharpness and its cutting capability.

As the temperature rises above 500° C., the decomposition products are volatilized and removed but degradation of the cutting edge continues by oxidation of the WC grains and the cobalt matrix in air. The oxides formed are readily removed by mechanical action, resulting in a fast degradation of the sharpness of the cutting edge.

OBJECTS AND SUMMARY OF THE INVENTION

It is an object of this invention to avoid or alleviate the problems of the prior art.

It is further an object of this invention to provide an improved cemented carbide for use in the machining of wood or wood products.

The invention provides a sintered hard alloy for tools for cutting wood comprising 30–98 volume % hard constituents in a binder phase based on a metal selected from the group consisting of Ni, Co and mixtures thereof, said hard constituents comprising a compound selected from the group consisting of oxides, carbides, nitrides, borides and mixtures thereof, of a metal selected from the group consisting of Al, Zr, Si, Ti and mixtures thereof with a mean grain size <1.5 $\mu$m, said binder phase comprising in solution, in weight %, Co max 95, Ni max 95, Cr 5–45.

DETAILED DESCRIPTION OF THE PREFERRED EMBODIMENTS OF THE INVENTION

The present invention relates to new types of hard materials with excellent properties regarding corrosion and oxidation resistance particularly satisfying the different needs of the wood industry.

Resistance to corrosion and oxidation has been achieved by alloying a cobalt and/or nickel and chromium binder and distributing in it hard constituents of a fine grain size to permit an optimal anchorage of the grains to the binder.

The material according to the present invention comprises 30 to 98 volume % of oxides, carbides, nitrides and/or borides of Al, Zr, Si and Ti, preferably $Al_2O_3$, ZrC, $ZrO_2$, SiC, $Si_3N_4$ and/or $TiB_2$. The mean grain size of said hard constituents is <1.5 $\mu$m, preferably <1.0 $\mu$m, most preferably <0.7 $\mu$m. The hard constituent grains are preferably precoated with cobalt and/or nickel before sintering. The binder comprises in solution, in weight %, Co max 95, Ni max 95 and Cr 5–45 and, in addition, W max 30, Mo max 15, Al max 2, Mn max 10, Si max 2, Cu max 10, Fe max 20, Ag max 5 and Au max 10.

The materials according to the present invention are manufactured by conventional powder metallurgical methods namely, milling, pressing and sintering. The alloy is preferably sintered under pressure.

The material according to the present invention is particularly useful for machining of particle board, chipboard, medium density fiberboard and dry woods. For cutting of particle board, chipboard and medium density fiberboard, the binder phase content shall be <10% by volume and for cutting of solid woods, the binder phase content shall be 10–70% by volume.

The invention is additionally illustrated in connection with the following Examples which are to be considered as illustrative of the present invention. It should be understood, however, that the invention is not limited to the specific details of the Examples.

EXAMPLE

An alloy consisting of, in volume %, 65% $Al_2O_3$ and 2% W in a binder of 19% Co and 14% Cr was tested against straight WC-Co (37%) material and a corrosion resistant cemented carbide of 56% WC, 35% Co, 9% Cr.

Chipboard 20 mm covered on both sides with a 0.16 mm layer of melamine was machined using a milling cutter and the following cutting data:

Diameter of the cutter: 125 mm
Cutting depth: 3 mm
Cutting speed: 40 m/s
Feed: 6 m/min
Edge angle: 55°
Rake angle: 20°
Clearance angle: 15°

The edge wear and the surface finish of the chipboard were measured at 2000, 5000, 20000, 40000 and 60000 meters with the following result expressed as average wear in μm at different cutting lengths.

| | Edge Wear Measured at Cutting Length, m | | | | |
|---|---|---|---|---|---|
| | 2000 | 5000 | 20000 | 40000 | 60000 |
| According to the invention | 26 | 39 | 68 | 90 | 110 |
| Corrosion resistant cemented carbide | 35 | 46 | 85 | 101 | 134 |
| Straight WC-Co | 44 | 49 | 105 | 144 | 182 |

The material according to the present invention shows significantly lower wear than the other two types of cemented carbide.

The surface finish produced by the inserts in the material according to the present invention was still acceptable after 60000 meters whereas for the other two types was found unacceptable after 40000 and 20000 meters, respectively.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered hard alloy comprising a sintered wood cutting tool comprising 30 to 98 volume % hard constituents in a binder phase based on a metal selected from the group consisting of Ni, Co and mixtures thereof, said hard constituents comprising a compound selected from the group consisting of oxides, carbides, nitrides, borides and mixtures thereof, of a metal selected from the group consisting of Al, Zr, Si, Ti and mixtures thereof with a mean grain size <1.5 μm, said binder phase comprising in solution, in weight %, Co max 95, Ni max 95, Cr 5–45, the hard constituents including at least $Al_2O_3$.

2. The sintered hard alloy of claim 1 wherein said binder phase also comprises in solution, in weight %, W max 30 and Mo max 15.

3. The sintered hard alloy of claim 1 wherein the hard constituents comprise a mixture of $Al_2O_3$ and at least one of ZrC, $ZrO_2$, SiC, $Si_3N_4$ and $TiB_2$.

4. The sintered hard alloy of claim 1 wherein the hard constituent grain size is <1.0 μm.

5. The sintered hard alloy of claim 1 wherein said binder phase further comprises in solution, in weight %, Al max 2, Mn max 10, Si max 2, Cu max 10, Fe max 20, Ag max 5 and Au max 10.

6. The sintered hard alloy of claim 1 wherein the hard constituent grains are pre-coated with cobalt and/or nickel.

7. The sintered hard alloy of claim 1 wherein the binder phase content is max 10 volume % when the alloy is used for cutting of chipboard, medium density fiberboard and particle board.

8. The sintered hard alloy of claim 1 wherein the binder phase has a content of 10–70 volume % when the alloy is used for the cutting of solid dried wood.

9. The sintered hard alloy of claim 1 wherein the hard constituents and the binder phase provide improved machining of wood products due to corrosion resistance of the hard alloy in a corrosive chemical environment at 300–500° C. and oxidation resistance of the hard alloy in an air environment above 500° C.

10. The sintered hard alloy of claim 1 wherein the binder is monophase.

11. A sintered hard alloy comprising a sintered wood cutting tool comprising 30–98 volume % hard constituents in a binder phase based on a metal selected from the group consisting of Ni, Co and mixtures thereof, said hard constituents comprising a compound selected from the group consisting of oxides, carbides, nitrides, borides and mixtures thereof, of a metal selected from the group consisting of Al, Zr, Si, Ti and mixtures thereof with a mean grain size <1.5 μm, said binder phase comprising in solution, in weight %, Co max 95, Ni max 95, Cr 5–45, the hard constituents consisting essentially of $Al_2O_3$.

12. The sintered hard alloy of claim 1 wherein the binder phase consists essentially of Co and Cr, the Co content in % by volume exceeding the Cr content.

13. The sintered hard alloy of claim 1 wherein the hard constituents are free of WC.

14. The sintered hard alloy of claim 1 wherein the binder phase includes at least 55 wt % of the Ni, Co and mixtures thereof.

15. The sintered hard alloy of claim 1 wherein the hard constituents consist essentially of oxides.

* * * * *